United States Patent [19]

Shiminski

[11] 4,378,828

[45] Apr. 5, 1983

[54] COMBINED COLLAPSIBLE WORKBENCH AND REMOVABLE TOOL CARRIER

[75] Inventor: James Shiminski, Sheffield, Mass.

[73] Assignee: Stanley Zilka, Monterey, Mass. ; a part interest

[21] Appl. No.: 251,507

[22] Filed: Apr. 6, 1981

[51] Int. Cl.[3] ..... B65D 85/54

[52] U.S. Cl. ..... 144/285; 108/35; 312/258

[58] Field of Search ..... 312/258, 262; 144/285, 144/286 R; 206/216; 108/35, 36, 38, 14

[56] References Cited

U.S. PATENT DOCUMENTS

| | | | |
|---|---|---|---|
| 1,287,175 | 12/1918 | Anderson | 144/285 |
| 2,139,293 | 12/1938 | Wallgren | 144/285 |
| 2,504,722 | 4/1950 | Owens | 144/285 |
| 2,697,460 | 12/1954 | Barnett | 144/285 |
| 2,759,507 | 8/1956 | Davis et al. | 144/285 |
| 2,791,251 | 5/1957 | Steele | 144/285 |
| 3,644,011 | 2/1972 | MacDonald | 312/258 |

FOREIGN PATENT DOCUMENTS

| | | | |
|---|---|---|---|
| 2447252 | 9/1980 | France | 144/286 R |

*Primary Examiner*—W. D. Bray

*Attorney, Agent, or Firm*—Gottlieb, Rackman & Reisman

[57] ABSTRACT

A collapsible workbench adapted to be moved from a folded condition to an unfolded, upright condition is disclosed. The workbench includes a top wall, side walls and leg panels, the latter movable from an open position for supporting the workbench to a closed position. The workbench contains a removable tool carrier which is movable from a storage position within a storage space defined by the top wall, side walls and the leg panels of the workbench to an operative position, located between the leg panels when the leg panels are opened. The collapsible workbench has a removable bottom wall which is selectively secured to the side walls of the workbench to maintain the leg panels in their closed position and selectively secured to the leg panels for maintaining the leg panels in their open position and also for maintaining the tool carrier in its operative position.

8 Claims, 9 Drawing Figures

FIG. 1
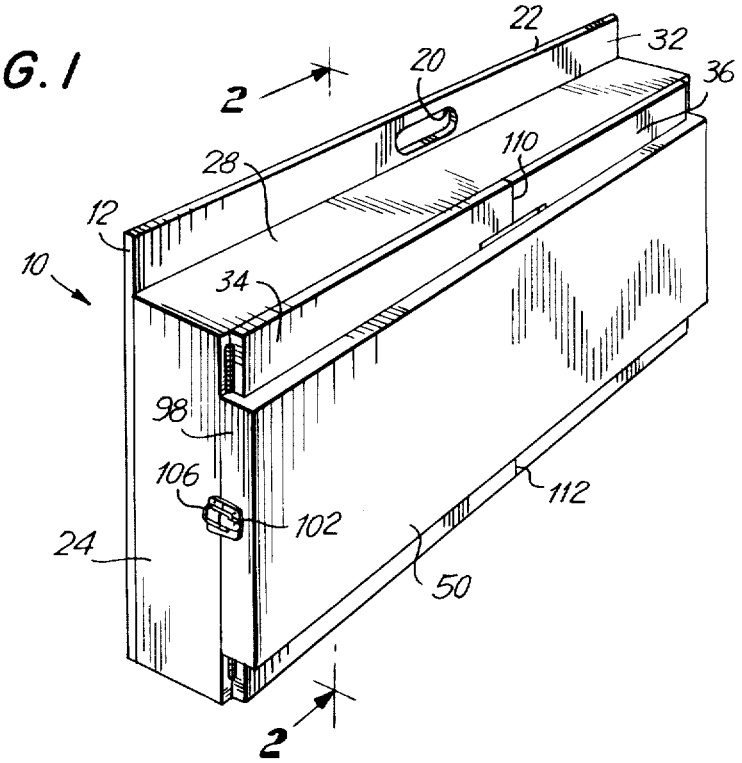
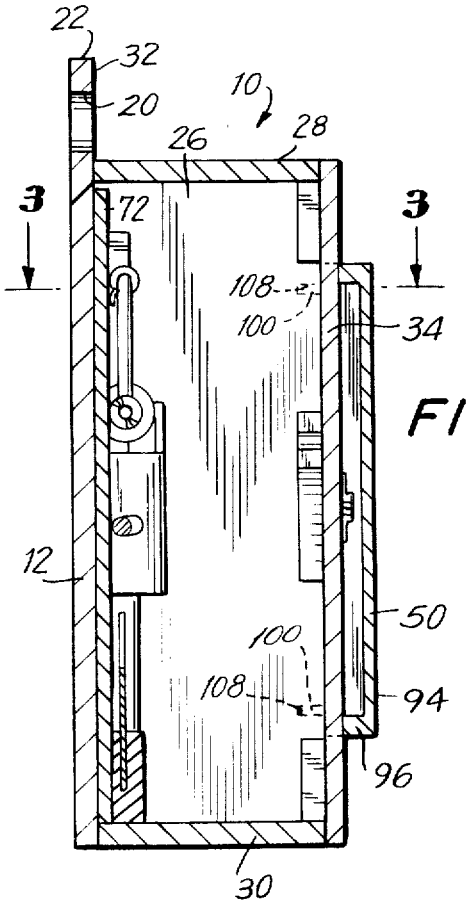
FIG. 2
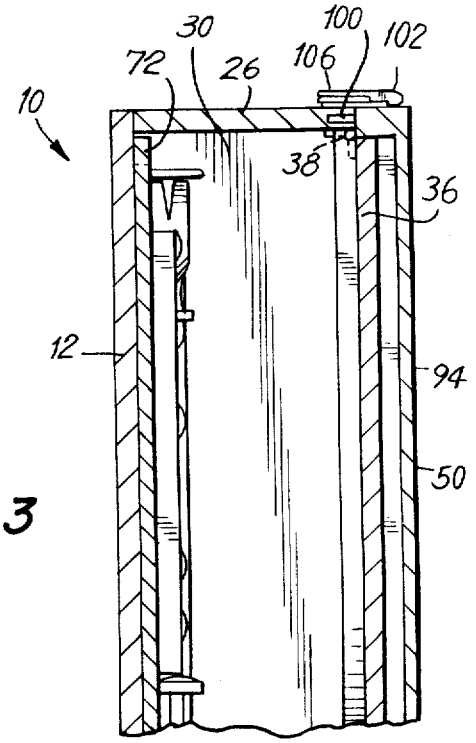
FIG. 3

COMBINED COLLAPSIBLE WORKBENCH AND REMOVABLE TOOL CARRIER

This invention relates generally to workbenches and, more particularly, to a combined collapsible workbench and removable tool carrier for use therewith.

Collapsible workbenches and tool kits are generally well known in the art. These are provided to enable the user to store and/or carry tools from one location to another. After transport from a storage location, the workbench is opened at a work location, thereby providing a work area for the user, for example, to allow the user to conduct hobby, home repairs, model building or the like using the tools.

The collapsible workbenches according to the prior art suffer from several disadvantages. For example, they are generally complex in configuration, thereby being expensive to manufacture and difficult to set up. Furthermore, the work space provided when the workbench is unfolded is often small, making the workbench difficult to use for relatively large projects. Still further, the tools are often difficult to store when the workbench is folded and/or are not easily accessible when the workbench is in its open position.

Accordingly, it is a broad object of the present invention to provide a new and improved combined collapsible workbench and removable carrier which overcomes the difficulties encountered by prior art collapsible workbenches.

A more specific object of the invention is to provide a combined collapsible workbench and removable tool carrier which has relatively few parts, thereby decreasing manufacturing costs while at the same time allowing the workbench to be folded and unfolded in an easy manner.

Yet another object of the invention is to provide a combined, collapsible workbench and removable tool carrier in which the tools are easily stored when the workbench is folded and readily accessible when the workbench is unfolded.

Yet another object of the present invention is to provide a combined collapsible workbench and removable tool carrier which combines suitable work space when the workbench is unfolded, but which may be collapsed to a relatively compact configuration when the workbench is folded enabling the workbench to be easily transported from one location to the other.

These and other objects of the present invention are obtained by providing a collapsible workbench which is adapted to be moved from a folded condition to an unfolded, upright condition. The workbench includes a top wall which provides a work surface when the workbench is in its unfolded, upright condition, side walls which extend downwardly from the top wall when the workbench is unfolded, and leg panels which are movable from an open position for supporting the workbench in its unfolded condition to a closed position when the workbench is folded. A removable tool carrier, movable from a storage position when the workbench is in its folded condition to an operative position when the workbench is unfolded, is also utilized. The tool carrier is maintained in its storage position within a storage space defined by the top wall, side walls and leg panels of the workbench and is maintained in its operative position by tool carrier receiving slots located on the leg panels. The workbench also has a bottom wall which is removably secured to the side walls when the workbench is folded thereby keeping the leg panels closed, and which is removably secured to the leg panels when the workbench is unfolded, thereby keeping the leg panels open and also maintaining the tool carrier within the slots on the leg panels.

The above brief description of the present invention will be more readily understood by reference to the following detailed description of a presently preferred, but nonetheless illustrative embodiment, of the present invention when considered in conjunction with the following drawings, wherein:

FIG. 1 is a perspective view of the combined collapsible workbench and removable tool carrier according to the present invention;

FIG. 2 is an enlarged sectional view, taken along the line 2—2 of FIG. 1;

FIG. 3 is a partial sectional view, taken along the line 3—3 of FIG. 2;

Figure 7:
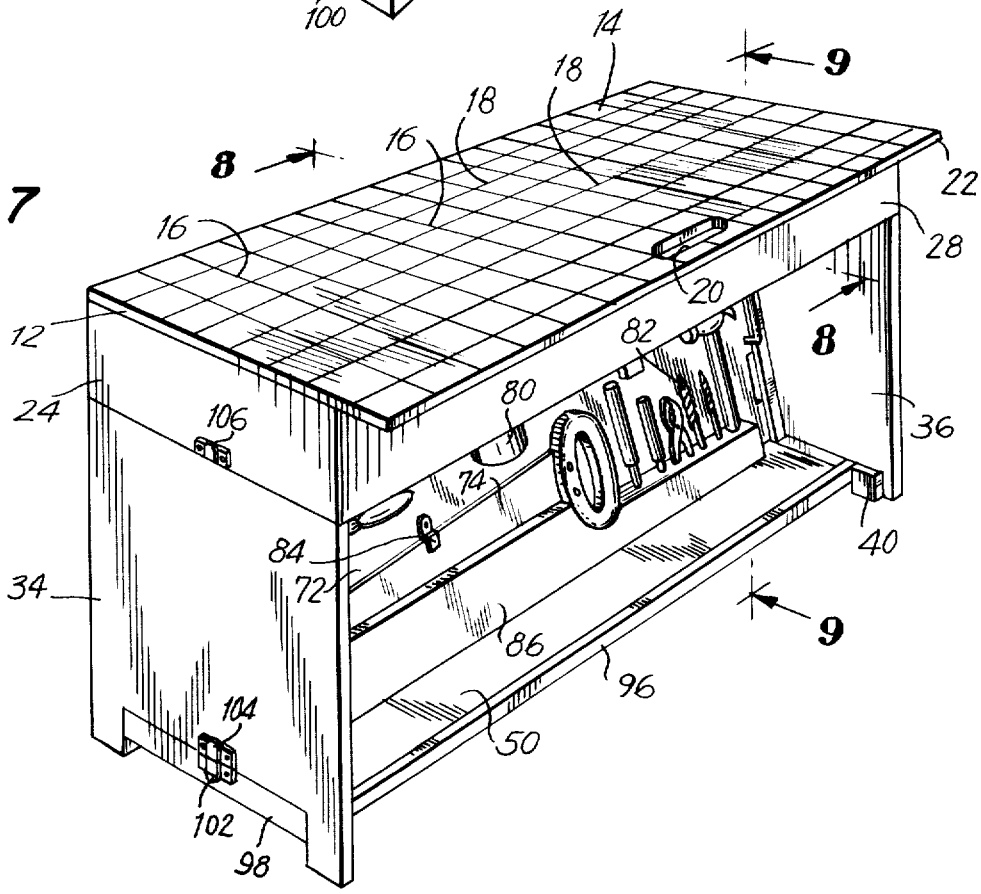
FIG. 7 is a perspective view showing the combined collapsible workbench and removable tool carrier in its unfolded, upright condition.

Referring now to the drawings, the combined collapsible workbench and removable tool carrier according to the present invention is generally designated 10. The workbench, which is adapted to be moved from a folded condition shown in FIG. 1 to an unfolded, upright condition shown in FIG. 7, includes a top wall 12 of rectangular configuration. As illustrated in FIG. 7, the top wall defines a horizontal work surface 14 when the workbench is unfolded. The work surface 14 may be scored or otherwise marked with an appropriate "graph" layer, consisting of sets of parallel lines 16, 18 which form a series of squares on the work surface. By choosing the size of the squares with an easily-remembered number, the "graph" layout may be used to calculate the length and/or width of wood or any other material placed on the layout.

A cutout 20, located midway along the length of the top wall and near top wall edge 22, provides a handle for grasping the workbench 10, allowing the workbench to be readily carried from one location to the other when the workbench is in the folded condition shown in FIG. 1.

Figure 5:
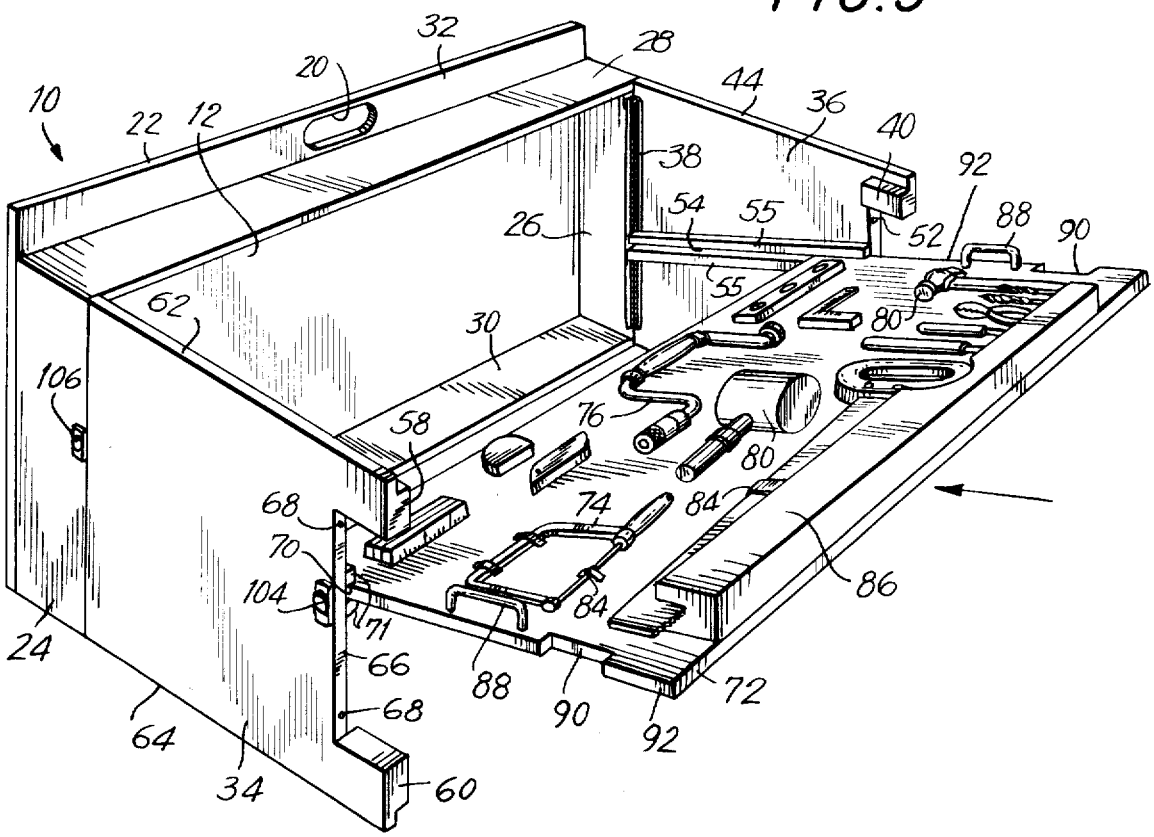
FIG. 5 is a perspective view of the combined collapsible workbench and removable tool carrier, illustrating the removable tool carrier being inserted into the tool carrier receiving slots.

The workbench also includes four side walls which extend downwardly from the top wall when the workbench is in its unfolded, upright condition. As shown particularly in FIG. 5, side walls 24 and 26 are of the same size, are parallel to each other and depend downwardly, respectively, from the left hand and right hand edges of the top wall 12. As also shown in FIG. 5, side wall 28 and side wall 30 are of the same size, are parallel to each other and depend downwardly from the top wall 12 at the front and rear of the top wall, respectively. Side wall 28 is offset slightly from the front edge 22 of the top wall, with the offset portion providing a lip 32 through which is located cutout handle 20.

The workbench is supported in its unfolded, upright condition by two leg panels 34, 36 which are movable from an open position, illustrated in FIG. 7, for supporting the workbench, to a closed position, illustrated in FIG. 1, when the workbench is in its folded condition.

A conventional hinge assembly 38 pivotally secures the leg panel 36 to the side wall 26 of the workbench, allowing the leg panel to move between its open position and closed position. The bottom of leg panel 36 is formed with front and rear reinforcing blocks 40, 42, respectively, which are provided to add strength to the leg panel and also to provide a firm support for the workbench when the workbench is unfolded. Reinforcing block 40 is offset slightly from the front edge 44 of leg panel 36, while reinforcing block 42 is offset slightly from the rear edge 46 of the leg panel 36. This enables the panel 36 to close flush against the side walls 28 and 30 of the workbench, without the blocks 40 and 42 interfering with these side walls.

The bottom of leg panel 36 also includes a cutout or notch 48 which, as will be explained, is sized to receive a bottom wall 50 of the workbench. In order to guide the bottom wall 50 in place, the notch 48 includes dowel-receiving holes 52, located adjacent to the front and rear reinforcing blocks 40 and 42. Leg panel 36 also has a tool carrier receiving slot 54 formed, for example, by parallel ribs 55 attached to the inside of the leg panel. As will be explained, the slot 54 receives a tool carrier carried by the workbench, thereby maintaining the tool carrier in an operative position when the workbench is unfolded.

Leg panel 34 is substantially identical to leg panel 36, both leg panels being the "mirror image" of the other. Thus, leg panel 34 is typically secured to side wall 24 by a hinge assembly 56; the leg panel includes front and rear reinforcing blocks 58, 60 which are offset from the front and rear edges 62, 64 of the leg panel, respectively, thereby allowing the panel to close and abut the side walls 28 and 30 which depend downwardly from the workbench top. Leg panel 34 also defines a notch 66 having dowel-receiving holes 68 for receiving the bottom wall 50 of the workbench. A slot 70, formed by two parallel ribs 71, is located on the inside of the leg panel, the slot receiving the tool carrier as will be explained.

The removable tool carrier, generally designated 72, is of overall rectangular, flat configuration and is provided to have mounted thereon a series of conventional tools, such as saws 74, drills 76, hammers 80, drill bits 82, and any other suitable tool to be used by the user of workbench 10. The tool carrier may maintain the tools in place by spring clips 84 or blocks 86 having apertures to receive the various tools. The particular tools carried by the carrier 72 are a matter of choice and do not form a part of the present invention. The carrier is of a size generally corresponding to, but slightly smaller than, the length of side walls 28 or 30 and the length of side walls 24 or 26, respectively. This enables the removable tool carrier 72 to fit within the space defined by the four side walls of the workbench, when the tool carrier is in its storage position and the workbench in its folded condition. This also enables the tool carrier 72 to fit within the slots 54, 70 of the leg panels when the tool carrier is in its operative position.

As illustrated in FIG. 5, the tool carrier advantageously includes handles 88 which facilitate in removing the tool carrier from its storage position and which also allow the tool carrier to be otherwise manipulated in an easy fashion by the user. Cutouts 90, formed at each of the ends 92 of the tool carrier, are formed to enable the carrier to be slipped into its storage position, without interfering with the ribs 55, 71 which form the carrier-receiving slots on the leg panels of the workbench.

The final component of the workbench 10 is the removable bottom wall 50. Bottom wall 50 is generally rectangular in configuration and has a bottom panel 94, upstanding side walls 96 and upstanding end walls 98 (see FIG. 6). The length of the bottom wall 50 is equal to the distance between the side walls 24 and 26 of the workbench, while the width of the bottom wall corresponds to the width of the notch 48 or 66 formed in the respective leg panels 36 or 34. The end walls 98 of the bottom wall include dowel pins 100 which fit into the corresponding dowel-receiving holes 52 or 68 formed in the leg panels, thereby locating the bottom wall 50 relative to the leg panels when the leg panels are opened. Clasps 102 carried by the bottom wall are provided and are adapted to lock with clasp members 104 carried by the leg panels, thereby keeping the bottom wall secured to the leg panels when the leg panels are opened, "locking" the leg panels in this position.

Figure 9:
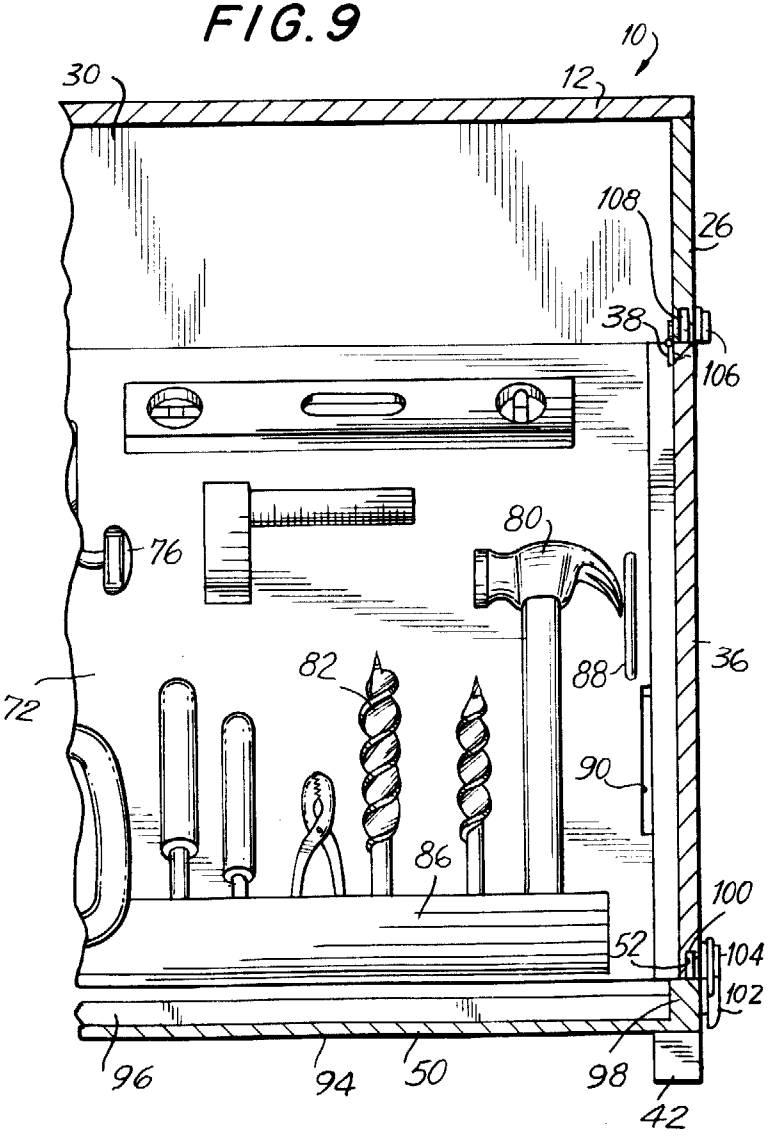
FIG. 9 is a sectional view, taken along the line 9—9 of FIG. 7.
Figure 8:
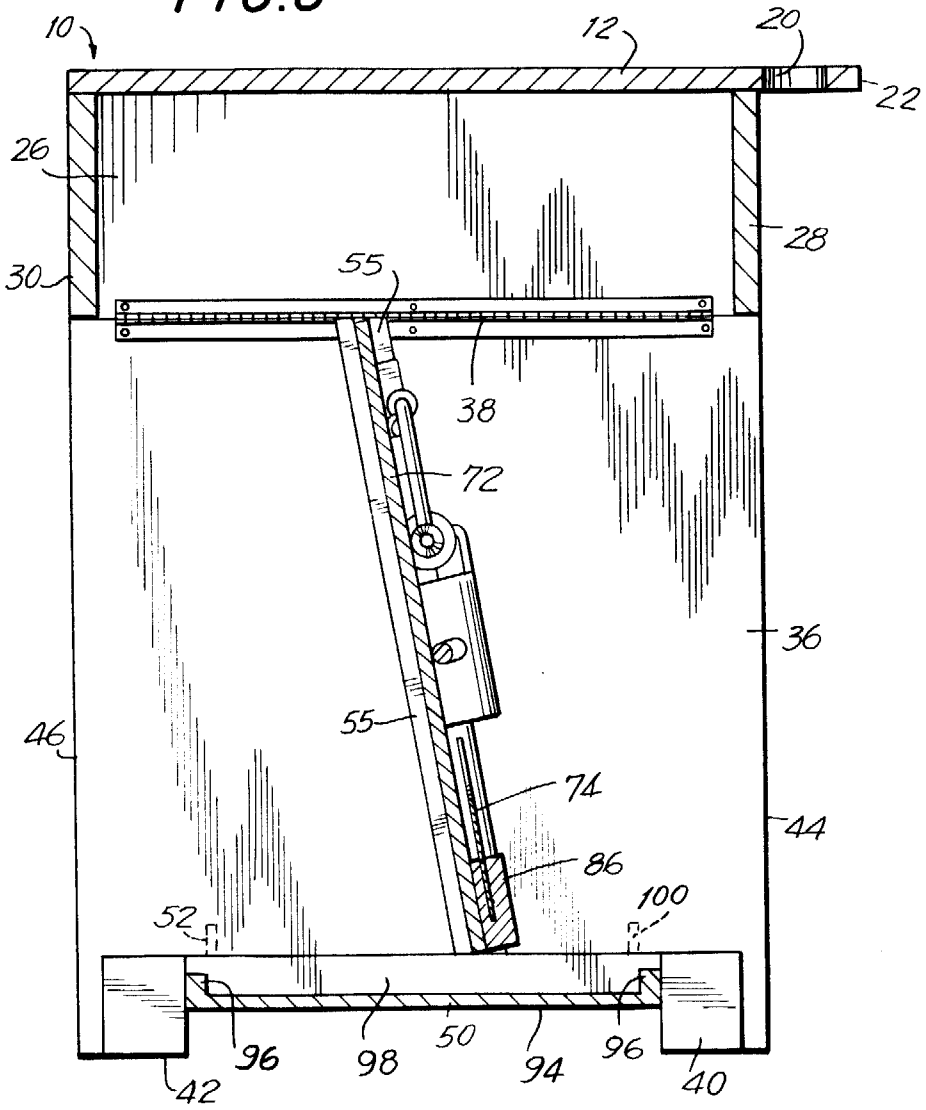
FIG. 8 is a sectional view, taken along the line 8—8 of FIG. 7.

In a similar fashion, side walls 24 and 26 have clasp members 106 which are provided to lock with clasps 102, in order to secure the bottom member 50 to the side walls, when the leg panels are closed and the workbench is in its folded condition. In order to facilitate the joining of clasp 102 with clasp member 106, the side walls 24, 26 also have dowel-receiving holes 108 (see FIG. 9), which receive the dowel pins 100 of the bottom wall, thereby locating the bottom wall and the side walls in proper position.

Figure 4:
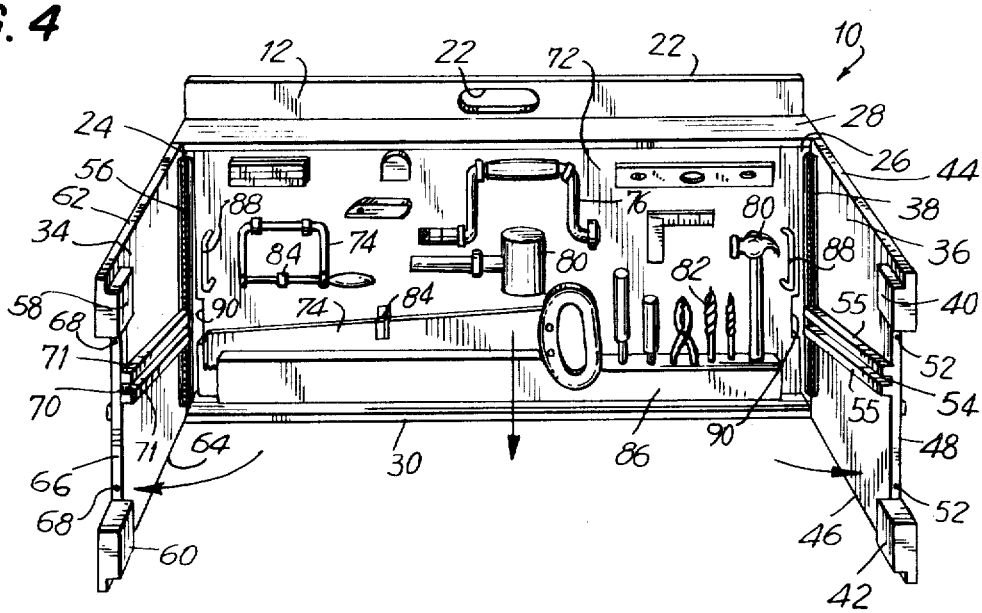
FIG. 4 is a perspective view of the combined collapsible workbench and removable tool carrier, with the leg panels opened and the bottom wall removed.

The operation of the combined collapsible workbench and removable tool carrier according to the present invention will be now readily apparent by particular reference to FIGS. 1 and 4–5.

FIG. 1 illustrates the combined collapsible workbench and removable tool carrier 10, showing the workbench in its folded condition. In this condition, the leg panels 34, 36 are folded closed (preferably, the leg panels are sized such that the ends or feet 110, 112 of the leg panels "meet" next to each other, at the midpoint of the length of the workbench). The leg panels are maintained closed by the bottom wall 50 which is secured to the side walls 24, 26 of the workbench, with clasps 102 being attached to clasp members 106. With the workbench in the folded condition illustrated in FIG. 1, removable tool carrier 72 is in its storage position, located in the storage space defined by the top wall 12, side walls 24–30 and closed leg panels 34, 36. In this condition, the workbench and removable tool carrier 10 may be readily transported from one location to another, by the user lifting the assembly via the cutout handle 20.

When it is desired to erect the workbench, clasps 102 are opened, and the bottom wall 50 of the workbench is removed. This enables the leg panels 34, 36 to pivot to their open position, illustrated in FIG. 4. The user then reaches in and, by grasping handles 88 of the removable carrier, slides the tool carrier out from its storage position, the notches 90 allowing the tool carrier to "clear" the ribs 55, 71 carried by the leg panels.

Figure 6:
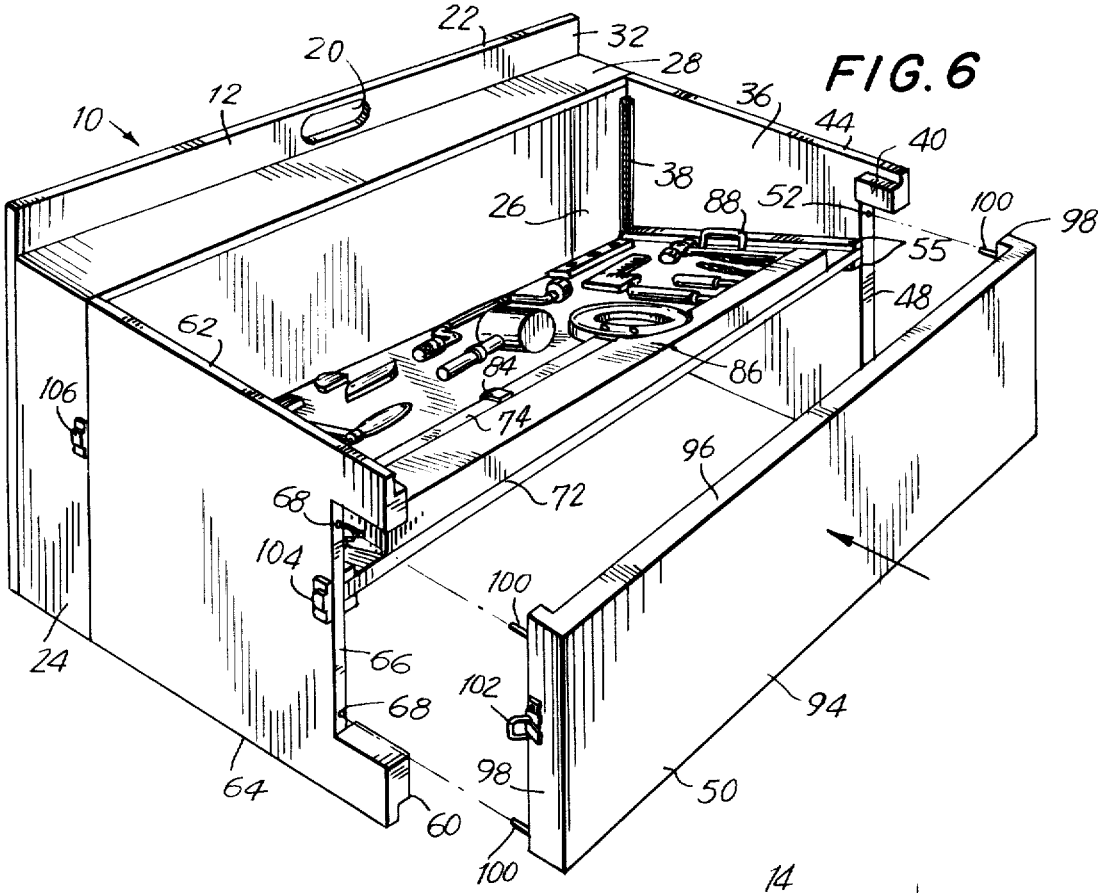
FIG. 6 is a perspective view, similar to that of FIG. 5, but showing the removable tool carrier fully inserted into the tool carrier receiving slots and also showing the bottom wall about to be secured to the leg panels.

The tool carrier, after being removed, is then inserted into the tool carrier-receiving slots 54, 70 of the leg panels, as illustrated in FIG. 5. The bottom wall 50 is then secured to the leg panels 34, 36, with the side walls 98 of the bottom wall fitting into the notches 48 or 66 of the leg panels. The dowel pins 100 and the dowel-receiving holes 52, 68 which receive the dowel pins, help locate the bottom wall relative to the leg panels, as illustrated in FIG. 6.

After the bottom wall has been properly located relative to the leg panels, clasps 102 are locked to the clasp members 104, in order to maintain the bottom wall in its proper position relative to the leg panels. The workbench is then rotated 90 degrees, to the position shown in FIG. 7, and the workbench is then ready for use with the top wall 12 providing a work surface and the tool carrier 72 being in its operative position, in which the tools carried by the tool carrier are readily accessible. It should be noted that the tool carrier is prevented from sliding out of the slots by the bottom wall 50. Moreover, the tool carrier 72 is "tilted" slightly in order to provide easy access for the tools carried by the tool carrier, that is, the tool carrier and top wall 12 define an angle less than 90 degrees.

It will be appreciated that the present invention provides a combined collapsible workbench and removable tool carrier which is relatively simple to construct, which may be moved from its folded condition to its unfolded, upright condition relatively easily, which has a sufficiently large top work surface, and which is relatively compact when the workbench is folded.

It should be understood that the foregoing description of the invention is by way of illustration only, and numerous modifications and changes are possible within the scope of the invention, which is defined by the following claims.

What is claimed is:

1. A collapsible workbench with a removable tool carrier adapted to be moved from a folded condition to an unfolded condition comprising a top wall for providing a work surface when the workbench is in its unfolded condition; side walls extending downwardly from said top wall when the workbench is in its unfolded condition; leg panels movable from an open position for supporting the workbench in its unfolded condition to a closed position when the workbench is in its folded condition; a tool carrier movable from a storage position when said workbench is in its folded condition to an operative position when said workbench is in its unfolded condition; a storage space for maintaining said tool carrier in its storage position when said workbench is in its folded condition, said storage space defined by said top wall, side walls and leg panels; and means for maintaining said tool carrier in its operative position, when said workbench is in its unfolded condition.

2. A collapsible workbench according to claim 1 wherein said means for maintaining said tool carrier in its operative position includes a removable bottom wall for said workbench.

3. A collapsible workbench according to claim 2 wherein said bottom wall is removably secured to the leg panels of the workbench when said workbench is in its unfolded condition.

4. A collapsible workbench according to claim 3 wherein said bottom wall maintains said leg panels in their open position when said bottom wall is secured to said leg panels.

5. A collapsible workbench according to claim 3 wherein said bottom wall is removably secured to the side walls when said workbench is in its folded condition.

6. A collapsible workbench according to claim 5 wherein said bottom wall maintains said leg panels in their closed position when said bottom wall is secured to said side walls.

7. A collapsible workbench according to claim 1 wherein said means for maintaining said tool carrier in its operative position includes slots located on the leg panels for receiving said tool carrier.

8. A collapsible workbench according to claim 7 wherein said tool carrier and said top wall define an angle less than 90 degrees when said tool carrier is in its operative position.

* * * * *